US009214104B1

(12) United States Patent
Matthews et al.

(10) Patent No.: US 9,214,104 B1
(45) Date of Patent: Dec. 15, 2015

(54) INTERCHANGEABLE FACE PLATE DISPLAY SYSTEM

(71) Applicants: Patrick T. Matthews, Ramsey, MN (US); Brad L. Flaherty, Ramsey, MN (US)

(72) Inventors: Patrick T. Matthews, Ramsey, MN (US); Brad L. Flaherty, Ramsey, MN (US)

( * ) Notice: Subject to any disclaimer, the term of this patent is extended or adjusted under 35 U.S.C. 154(b) by 0 days.

(21) Appl. No.: 14/482,428

(22) Filed: Sep. 10, 2014

(51) Int. Cl.
*G09F 7/02* (2006.01)
*G09F 15/00* (2006.01)
*G09F 15/02* (2006.01)

(52) U.S. Cl.
CPC ..... *G09F 15/0068* (2013.01); *G09F 15/02* (2013.01)

(58) Field of Classification Search
USPC ..... 40/605, 611.01, 612, 730; 248/913
See application file for complete search history.

(56) References Cited

U.S. PATENT DOCUMENTS

| | | | | |
|---|---|---|---|---|
| 4,512,097 | A * | 4/1985 | Zeigler | 40/610 |
| 4,809,471 | A * | 3/1989 | Wichman et al. | 52/109 |
| 6,758,354 | B2 * | 7/2004 | Carletti | 211/189 |
| 6,981,350 | B1 * | 1/2006 | Redmon | 52/646 |
| 8,296,981 | B1 * | 10/2012 | Gardinier et al. | 40/605 |

* cited by examiner

*Primary Examiner* — Joanne Silbermann
(74) *Attorney, Agent, or Firm* — Dave Alan Lingbeck

(57) ABSTRACT

An interchangeable face plate display system for accommodating multiple graphic displays on the same frame. The interchangeable face plate display system includes a hub member adapted to interconnect elongate frame members of a display structure and including a block having a front side, a back side, a top side, and a bottom side; and an interchangeable support member removably connected to the hub member for supporting graphics upon the display structure.

14 Claims, 5 Drawing Sheets

INTERCHANGEABLE FACE PLATE DISPLAY SYSTEM

BACKGROUND OF THE INVENTION

1. Field of the Invention

The present invention relates to graphic display systems and more particularly pertains to a new interchangeable face plate display system for accommodating multiple graphic displays on the same frame.

2. Description of the Prior Art

The use of graphic display systems is known in the prior art. More specifically, graphic display systems heretofore devised and utilized are known to consist basically of familiar, expected and obvious structural configurations, notwithstanding the myriad of designs encompassed by the crowded prior art which have been developed for the fulfillment of countless objectives and requirements.

The prior art describes a collapsible three dimensional framework includes a plurality of tubular rods connected to each other by means of articulation joints. Each of the joints consists of a block divided into two matching pieces. The block has a plurality of cavities each of which is open on a respective side face and on a back face of the block. The ends of respective rods are inserted in the cavities and are connected to the block by transverse pivot pins. Another prior art describes a portable display system including a collapsible frame comprised of a plurality of box units defined by spaced hubs with pivotable members extending therebetween. More than one of these display systems can be mounted one to another with a clip that is provided between adjacent outward-most hubs of two different systems. Also another prior art describes a collapsible framework constructed of rods pivotally joined at their ends to hubs to form a self-standing unit when expanded and to fold into a small set of nearly parallel rods when folded. Further, another prior art describes a hub structure for a collapsible frame which comprises a pair of similar members having radiating arms. The hub members are in contact with each other. The arms have pivot attachment points for struts and all of the pivot points lie in the same plane. Yet, another prior art describes a clip for mounting display panels upon display frames, the mounting clip including a clip body having a plurality of arms, a sleeve on each arm, each sleeve carrying a hook-like projection for entering an opening of an associated display panel and a spring connected to the sleeves for drawing the sleeves toward a center of the clip body. In addition, another prior art describes a support and attachment brace for a collapsible display panel structure having hub assemblies with outwardly facing fastening buttons thereon, including an elongated rigid bar or brace with top and bottom ends each being adapted for releasably interconnecting with one of a pair of confronting vertically aligned fastening buttons. A magnetic strip along the length of the brace provides a means for releasably attaching a sheet of material to the brace to cover the panel structure or display a graphic representation. While these devices fulfill their respective, particular objectives and requirements, the aforementioned patents do not disclose a new interchangeable face plate display system.

SUMMARY OF THE INVENTION

The general purpose of the present invention, which will be described subsequently in greater detail, is to provide a new interchangeable face plate display system which has many of the advantages of the graphic display systems mentioned heretofore and many novel features that result in a new interchangeable face plate display system which is not anticipated, rendered obvious, suggested, or even implied by any of the prior art graphic display systems, either alone or in any combination thereof. The present invention includes a hub member adapted to interconnect elongate frame members of a display structure and including a block having a front side, a back side, a top side, and a bottom side; and an interchangeable support member removably connected to the hub member for supporting graphics upon the display structure. None of the prior art includes the combination of the elements of the present invention.

There has thus been outlined, rather broadly, the more important features of the interchangeable face plate display system in order that the detailed description thereof that follows may be better understood, and in order that the present contribution to the art may be better appreciated. There are additional features of the invention that will be described hereinafter and which will form the subject mailer of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new interchangeable face plate display system which has many of the advantages of the graphic display systems mentioned heretofore and many novel features that result in a new interchangeable face plate display system which is not anticipated, rendered obvious, suggested, or even implied by any of the prior art graphic display systems, either alone or in any combination thereof.

Still another object of the present invention is to provide a new interchangeable face plate display system for accommodating multiple graphic displays on the same frame.

Still yet another object of the present invention is to provide a new interchangeable face plate display system that the face plates or the graphic supports can be easily changed to match the graphics to be displayed without having to use any tools or having separate display frames or structures tor the different graphics.

Even still another object of the present invention is to provide a new interchangeable face plate display system that conveniently connects and disconnects from the hub members to which the display structure is erected.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
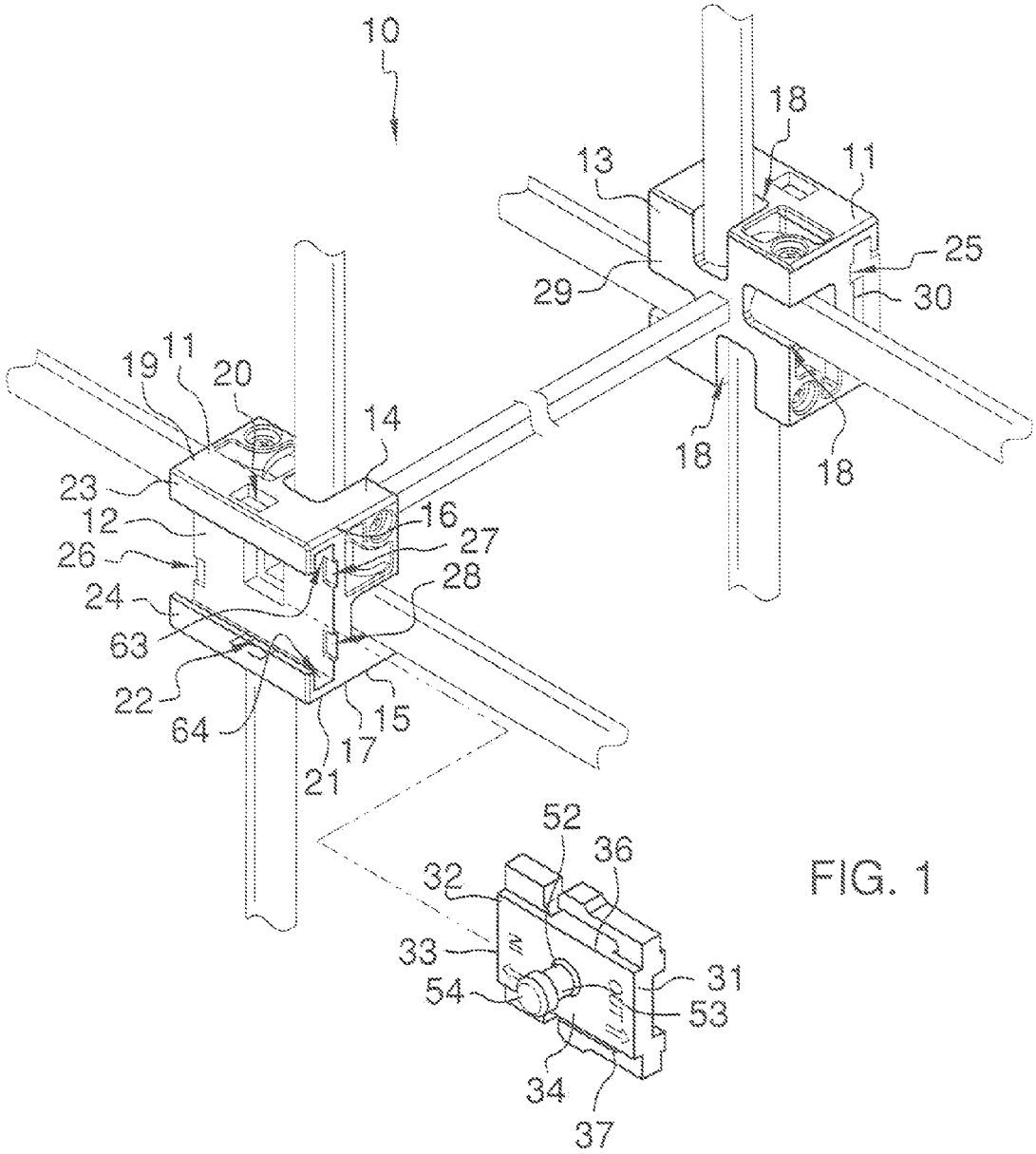
FIG. 1 is an exploded front perspective view of a new interchangeable face plait display system according to the present invention.

With reference now to the drawings, and in particular to FIGS. 1 through 6 thereof, a new interchangeable face plate display system embodying the principles and concepts of the present invention and generally designated by the reference numeral 10 will be described.

As best illustrated in FIGS. 1 through 6, the interchangeable face plate display system 10 may generally comprise a hub member 11 adapted to interconnect elongate frame members 60 of a display structure or rack 61 and including a solid block 62 having a front side 12, a back side 13, a top side 14, and a bottom side 15; and an interchangeable support member 31 removably connected to the hub member 11 for supporting graphics upon the display rack 61. The hub member 11 may have slots 18 disposed in the back side 13, top aide 14 and bottom side 15 for receiving end portions of the elongate frame members 60. The hub member 11 may also include a first planar extension 19 integrally extending from and along a longitudinal edge 16 of the top side 14 and extending forwardly of and perpendicular to the front side 12 of the hub member 11 and may further include a second planer extension 21 integrally extending from and along a longitudinal edge 17 of the bottom side 15 of the hub member 11 and extending forwardly of and perpendicular to the front side 12. The first planar extension 19 may extend from one end of the top side 14 to an opposed end of the top side 14, and the second planar extension 21 may extend from one end of the bottom side 15 to as opposed end of the bottom side 15. The first planar extension 19 may have a first opening 20 disposed therethrough and the second planar extension 21 may have a second opening 22 extending therethrough.

The hub member 11 may also include a first flange 23 integrally extending from and along a longitudinal outer edge of the first planar extension 19 and also extending toward the bottom side 15 and being spaced forwardly of the front side 12 of the hub member 11 to form a first track 63 between the first flange 23 and the top side 14 of the hub member 11. The hub member 11 may also include a second flange 24 integrally extending from and along a longitudinal outer edge of the second planar extension 21 and also extending toward the top side 14 and being spaced forwardly of the front side 12 of the hub member 11 to form a second track 64 between the first flange 23 and the and the bottom side 15 of the hub member 11. The hub member 11 may further include depressions 25-28 disposed in and at opposed ends of the front side 12 with the depressions 25-28 spaced along the opposed ends of the front side 12.

As illustrated in FIGS. 1 through 5, the interchangeable support member 31 may include a plate 32 having a main portion 33 with a front side 34, a back side 35, a first longitudinal edge 36 an a second longitudinal edge 37 and also having wing portions 38-41 extending outwardly from the first and second longitudinal edges 36, 37 at opposed lateral edges of the main portion 33. The wing portions 38-41 may be recessed relative to the front side 34 of the main portion 33 of the interchangeable support member 31. The interchangeable support member 31 may further include a first cantilevered connector 42 integrally extending from one of the wings 38 and spaced from and extending parallel to the first longitudinal edge 36 of the main portion 33 and being removably received in the first track 63, and may also include a second cantilevered connector 43 integrally extending from another of the wings 39 and spaced from and extending parallel to the second longitudinal edge 37 of the main portion 33 and being removably received in the second track 64. The first cantilevered connector 4 may have a first lug 44 integrally disposed at a distal end thereof and being removably and biasedly receivable in the first opening 20 of the hub member 11, and the second cantilever member 43 may have a second lug 45 integrally disposed at a distal end thereof and being removably and biasedly receivable in the second opening 22 of the hub member 11. The first and second lugs 44, 45 may have chamfered front corner edges 46, 47 for facilitating insertion of the first and second lugs 44, 45 into the first and second openings 20, 22 and may also have chamfered back corner edges 48, 49 for facilitating removing the first and second lugs 44, 45 from the first and second openings 20, 22.

Figure 2:
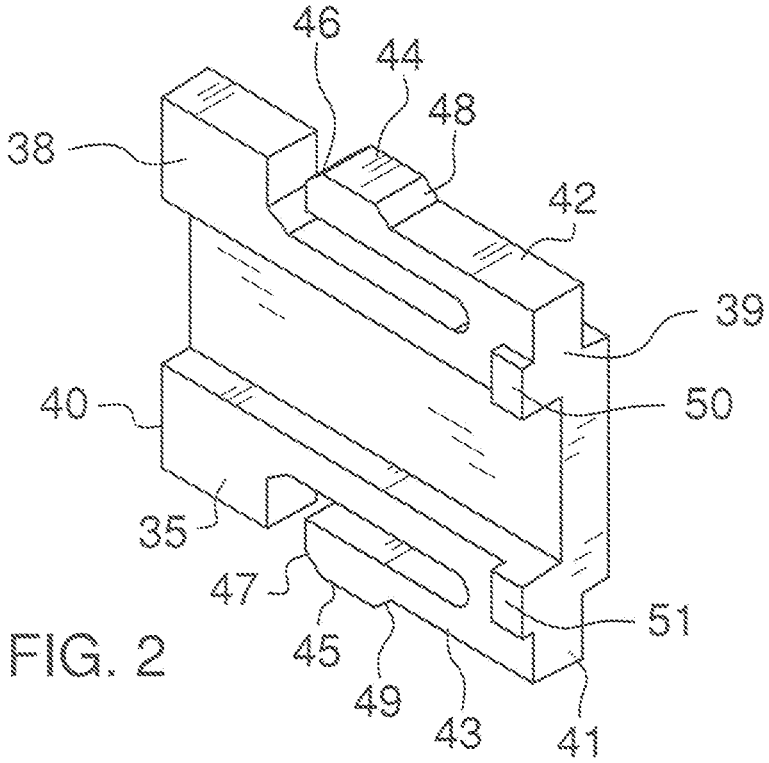
FIG. 2 is a rear perspective view of a face plate of the present invention.
Figure 3:
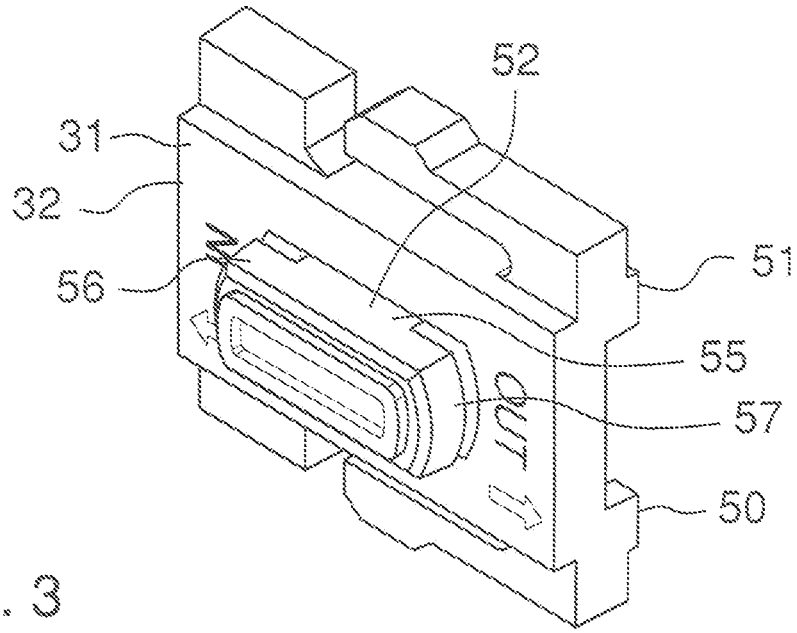
FIG. 3 is a front perspective view of a second embodiment of the face plate of the present invention.
Figure 4:
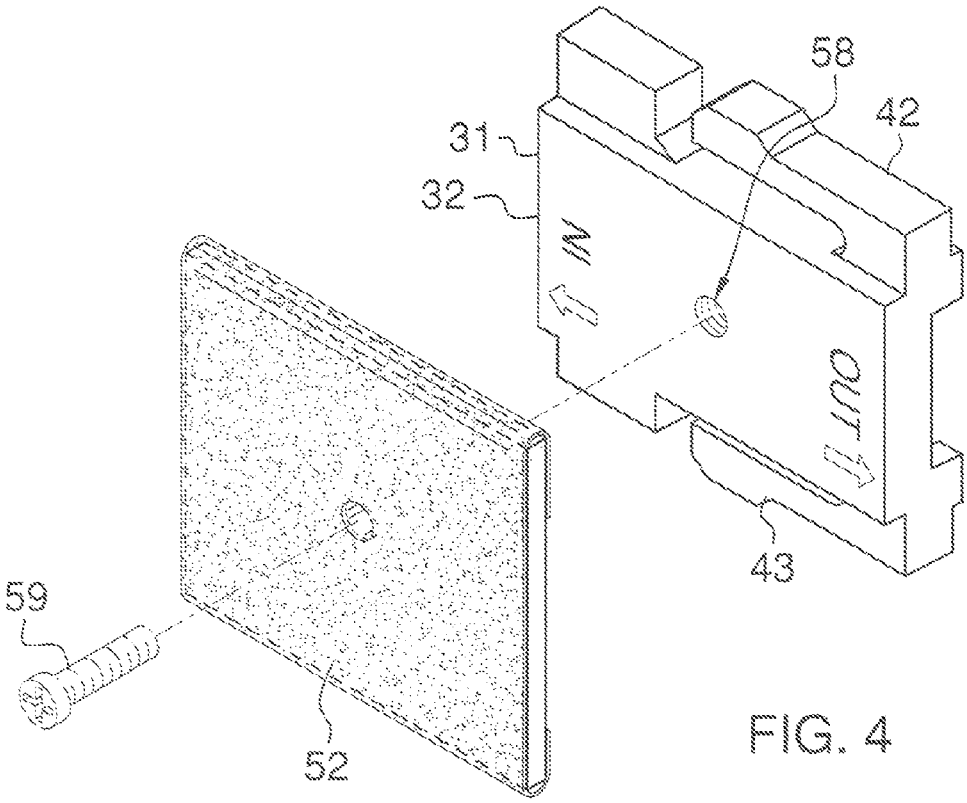
FIG. 4 is an exploded front perspective view of a third embodiment of the face plate of the present invention.
Figure 5:
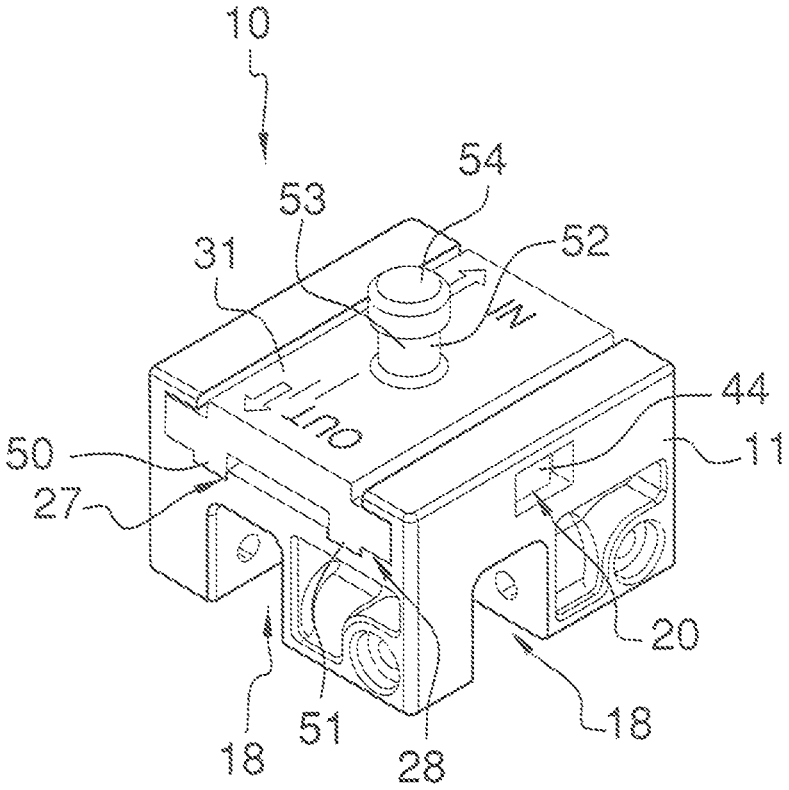
FIG. 5 is front perspective view of the face plate inserted upon the face of the hub member of the present invention.
Figure 6:
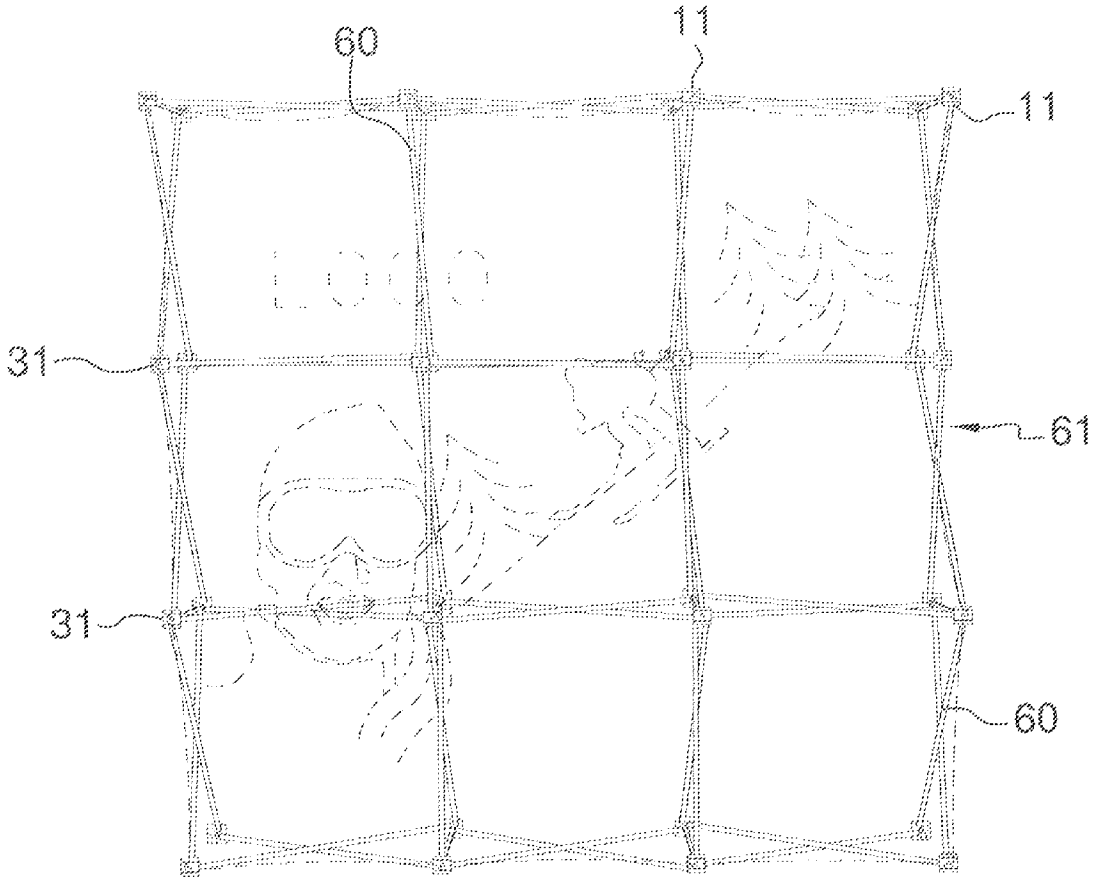
FIG. 6 is a perspective view of a display rack to which the present invention is mounted to support graphics.

As shown in FIG. 2, the interchangeable support member 31 may have stop tabs 50, 51 integrally disposed upon the buck side 35 near one of the lateral edges 30 thereof and being removably engageable with the depressions 25-28 in the front side 12 of the hub member 11 to guide and situate the interchangeable support member 31 upon the hub member 11. The interchangeable support member 31 may have a graphics support member 52 conventionally in communication with the front side 34 of the main portion 33 for supporting graphics displayed upon the display rack 61. The graphics support member 52 may include a peg 53 conventionally disposed upon and extending from the front side 34 thereof with the peg 33 having a knob 54 at a distal end thereof for retaining the graphics thereupon. As a second embodiment as shown in FIG. 3, the graphics support member 52 may include a pedestal 55 conventionally disposed upon and extending from the front side 34 thereof and also has opposed flange members 56, 57 integrally extending in opposite directions and outwardly from and perpendicular to the pedestal 55 and also spaced from the front side 34 of the interchangeable support member 31 for receiving at least a portion of the graphics between the flange members 56, 57 and the front side 34 of the interchangeable support member 31. As a third embodiment as shown in FIG. 4, the interchangeable support member 31 may have at least one hole 58 disposed through the main portion 33 thereof to support a fastener 59 including a hook and loop fastener for supporting the graphics thereupon.

In use, the interchangeable support member 31 may be removably connected to the hub member 11 by inserting the first and second cantilevered connectors 42, 43 in the first and second tracks 63, 64 of the hub member 11, and the first and second lugs 44, 45 are removably and biasedly received and retained in the first and second openings 20, 22 of the hub member 11 to retain the interchangeable support member 31 to the hub member 11. The chosen graphics are either depending from the peg 53, removably attached with the fastener 59 to or inserted between the flange members 56, 57 and the main portion 33 of the interchangeable support member 31 depending upon the type or style of graphics to support and display the graphics upon the interchangeable support member 31 and the display rack 61.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only the principles of the interchangeable face plate display system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An interchangeable face plate display system comprising:

a hub member adapted to interconnect elongate frame members of a display structure and including a block having a front side, a back side, a top side, and a bottom side, wherein the hub member also includes a first planar extension at the top side and further includes a second planar extension at the bottom side, wherein the hub member also includes a first flange at the first planar extension forming a first track, wherein the hub member also includes a second flange at the second planar extension forming a second track, wherein the first planar extension has a first opening disposed therethrough and the second planar extension has a second opening extending therethrough; and an interchangeable support member removably connected to the hub member for supporting graphics upon the display structure.

2. The interchangeable face plate display system as described in claim 1, wherein the interchangeable support member includes a plate having a main portion with a front side, a back side, a first longitudinal edge and a second longitudinal edge and also having wing portions extending outwardly from the first and second longitudinal edges.

3. The interchangeable face plate display system as described in claim 2, wherein the wing portions are recessed relative to the front side of the main portion of the interchangeable support member.

4. The interchangeable face plate display system as described in claim 3, wherein the hub member further includes depressions disposed in and at opposed ends of the front side, wherein the depressions are spaced along the opposed ends of the front side.

5. The interchangeable face plate display system as described in claim 4, wherein the interchangeable support member has stop tabs disposed upon the back side near a lateral edge thereof and being removably engageable with the depressions in the front side of the hub member to guide and situate the interchangeable support member upon the hub member.

6. The interchangeable face plate display system as described in claim 2, wherein the interchangeable support member further includes a first cantilevered connector removably received in the first track, and also includes a second cantilevered connector removably received in the second track.

7. The interchangeable face plate display system as described in claim 6, wherein the first cantilevered connector is connectable in the first opening of the hub member, and the second cantilevered connector is connectable in the second opening of the hub member to removably retain the interchangeable support member to the hub member.

8. The interchangeable face plate display system as described in claim 6, wherein the first cantilevered connector extends from one of the wing portions and is spaced from and extending parallel to the first longitudinal edge of the main portion, and the second cantilevered connector extends from another of the wings and is spaced from and extending parallel to the second longitudinal edge of the main portion.

9. The interchangeable face plate display system as described in claim 6, wherein the first cantilevered connector has a first lug disposed at a distal end thereof and being removably and biasedly receivable in the first opening of the hub member, wherein the second cantilever member has a second lug disposed at a distal end thereof and being removably and biasedly receivable in the second opening of the hub member.

10. The interchangeable face plate display system as described in claim 9, wherein the first and second lugs have chamfered front corner edges for facilitating insertion of the first and second lugs into the first and second openings and also have chamfered back corner edges for facilitating removing the first and second lugs from the first and second openings.

11. The interchangeable face plate display system as described in claim 2, wherein the interchangeable support member has a graphics support member in communication with the front side thereof for supporting graphics displayed upon the display structure.

12. The interchangeable face plate display system as described in claim 11, wherein the graphics support member includes a peg disposed upon and extending from the front side thereof with the peg having a knob at a distal end thereof for retaining the graphics thereupon.

13. The interchangeable face plate display system as described in claim 11, wherein the graphics support member includes a pedestal disposed upon and extending from the front side thereof and also has opposed flange members extending in opposite directions and outwardly from and perpendicular to the pedestal and also spaced from the front side of the interchangeable support member for receiving at least a portion of the graphics between the flange members and the front side of the interchangeable support member.

14. The interchangeable face plate display system as described in claim 11, wherein the interchangeable support member has at least one hole disposed through the main portion thereof to support a fastener including a hook and loop fastener for supporting the graphics thereupon.

* * * * *